United States Patent [19]

Ohwada

[11] Patent Number: 5,011,307

[45] Date of Patent: Apr. 30, 1991

[54] WIRE DOT PRINTER HEAD WITH ARMATURE GUIDES

[75] Inventor: Isao Ohwada, Tamayama, Japan

[73] Assignee: Alps Electric Co., Ltd., Tokyo, Japan

[21] Appl. No.: 315,205

[22] Filed: Feb. 23, 1989

Related U.S. Application Data

[63] Continuation of Ser. No. 133,549, Dec. 16, 1987, abandoned.

[30] Foreign Application Priority Data

Apr. 20, 1987 [JP] Japan ..... 62-58635[U]

[51] Int. Cl.[5] ..... B41J 2/275

[52] U.S. Cl. ..... 400/124; 101/93.05

[58] Field of Search ..... 400/124; 101/93.05

[56] References Cited

U.S. PATENT DOCUMENTS

| | | | |
|---|---|---|---|
| 4,230,412 | 10/1980 | Hebert | 400/124 |
| 4,260,270 | 4/1981 | Cavallari | 400/124 |
| 4,338,585 | 7/1982 | Volke | 400/124 |
| 4,453,840 | 6/1984 | Hodne | 400/124 |
| 4,511,269 | 4/1985 | Takahashi et al. | 400/124 |
| 4,513,496 | 4/1985 | Wang | 400/124 |
| 4,618,276 | 10/1986 | Blomquist et al. | 400/124 |
| 4,723,854 | 2/1988 | Sakaida et al. | 400/124 |
| 4,768,892 | 9/1988 | Brown et al. | 101/93.48 |

FOREIGN PATENT DOCUMENTS

| | | | |
|---|---|---|---|
| 2256813 | 5/1973 | Fed. Rep. of Germany | 400/124 |
| 29466 | 2/1982 | Japan | 400/124 |
| 85773 | 5/1984 | Japan | 400/124 |
| 155057 | 9/1984 | Japan | 400/124 |
| 154950 | 7/1986 | Japan | 400/124 |
| 169259 | 7/1986 | Japan | 400/124 |

*Primary Examiner*—David A. Wiecking

*Attorney, Agent, or Firm*—Guy W. Shoup; Paul J. Winters

[57] ABSTRACT

A head for a wire dot printer wherein the distance between each pair of adjacent armatures in a circumferential direction of a housing can be minimized to allow reduction in size of the head. The head includes a plurality of armatures each of which has a laterally extending tab formed on one side and a recess formed on the other side of of an outer end portion thereof. A guide member is located between each two adjacent ones of the armatures and has a recess and a tab formed on opposite sides of an outer end portion thereof. The recess and the tab of the guide member fit with the tab of one of the adjacent armatures and the recess of the other adjacent armatures, respectively.

3 Claims, 1 Drawing Sheet

WIRE DOT PRINTER HEAD WITH ARMATURE GUIDES

This application is a continuation of application Ser. No. 07/133,549, filed Dec. 16, 1987 now abandoned.

BACKGROUND OF THE INVENTION

This invention relates to a head for a wire dot printer, and more particularly to a head for a wire dot printer wherein a mounting structure for an armature is improved.

FIG. 3 shows an exemplary one of print heads which are used in conventional wire dot printers. The print head shown includes a hollow cylindrical housing 1, and a plurality of movable members located in a circumferential row within the housing 1 and each including a radially extending armature 2 and a wire 3 securely mounted at an end of the armature 2 by a suitable means such as brazing and extending laterally in a printing direction. Each of the armatures 2 is resiliently pressed at an outer end thereof against a yoke core 5 by a respective armature spring 4 interposed between the armature 2 and a ceiling portion of the housing 1 and is thus supported for pivotal motion on the yoke core 5. Each of the armatures 2 is urged upwardly at an inner end thereof toward an annular support projection 7 formed on an inner face of the ceiling portion of the housing 1 by a respective reset spring 6 interposed between the armature 2 and the yoke core 5. Thus, each of the armatures 2 is reciprocally rocked in upward and downward directions around a fulcrum at the outer end thereof by a magnetic force acting in a downward direction in FIG. 3 and a returning force of the reset spring 6. Upon such reciprocal rocking motion of the armatures 2, the wires 3 integrally secured to the armatures 2 are moved axially first in the printing direction and then in the opposite direction to effect printing while they are held in a regular arrangement by an intermediate guide plate 10 and an end guide plate 11 both mounted in a tapering annular housing 9 extending in the printing direction from the housing 1 so that they may provide impact points which generally make two parallel lines.

Referring to FIG. 4, the conventional print head further includes a guide member 12 located between each pair of adjacent ones of the armatures 2 for restraining movement of the adjacent armatures 2 in directions other than the upward and downward directions in FIG. 3. Further, each of the armature 2 has a pair of tabs 13 formed on opposite sides of the outer end thereof and extending in a symmetrical relationship in opposite substantially circumferential directions of the housing 1 while each of the guide members 12 has a receiving portion 14 which has a pair of recesses **14*a* formed on opposite sides thereof for receiving opposing ones of the tabs 13 of the adjacent pair of armatures 2** therein.

However, with the conventional print head described above, since each of the armatures 2 has a pair of tabs 13 formed thereon, it has a relatively great width in the circumferential direction of the housing 1. Besides, since there is a guide member 12 located between opposing ones of the tabs 13 of an adjacent pair of guide members 12, it is necessary to assure a relatively great distance between a pair of adjacent armatures 2 in the circumferential direction of the housing 1. Accordingly, the conventional print head has a drawback that it has a relatively large size and cannot contribute to reduction in size of a printer.

SUMMARY OF THE INVENTION

It is an object of the present invention to provide a head for a wire dot printer which eliminates the drawback of the conventional head for a wire dot printer described above and wherein the distance between each pair of adjacent armatures in a circumferential direction of a housing can be reduced to allow reduction in size of the head.

In order to attain the object, according to the present invention, there is provided a head for a wire dot printer which includes a cylindrical housing, a plurality of armatures located in a circumferential row and extending in radial directions within the housing, each of the armatures being supported at a radially outer end portion thereof for reciprocal rocking motion to actuate a print wire secured to a radially inner end portion thereof, and a guide member located between each pair of adjacent ones of the armatures for restraining movement of the adjacent armatures in directions other than directions of the reciprocal rocking motion, wherein each of the armatures has a laterally extending tab formed on one side of the outer end portion thereof and a recess formed on the other side of the outer end portion thereof while each of the guide members has a recess and a tab formed on opposite sides of an outer end portion thereof for fitting with the tab of one of the adjacent armatures and the recess of the other adjacent armatures, respectively.

In the head for a wire dot printer of the present invention, each of the armatures has a laterally extending tab formed on one side of a radially outer end portion thereof and a recess formed on the other side of the outer end portion thereof such that the position of the center of the outer end portion thereof in a widthwise direction thereof may be offset or displaced relative to the position of the center of the remaining portion thereof in the widthwise direction thereof. Meanwhile, a guide member having a recess and a tab formed on opposite sides of an outer end portion thereof for fitting with the tab and the recess of such an armature, respectively, is located between each adjacent pair of the armatures. Accordingly, the distance between each two adjacent armatures in a circumferential direction of the housing can be reduced comparing with that of the conventional print head. Accordingly, the armatures can be arranged in a high density, and the head can be reduced in size.

The above and other objects, features and advantages of the present invention will become apparent from the following description and the appended claims, taken in conjunction with the accompanying drawing.

DETAILED DESCRIPTION OF THE PREFERRED EMBODIMENT

Figure 1:
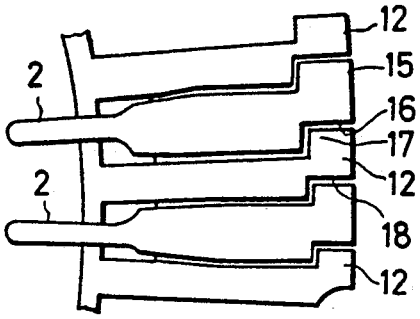
FIG. 1 is a plan view of essential part of a housing of a head for a wire dot printer showing a preferred embodiment of the present invention.
Figure 2:
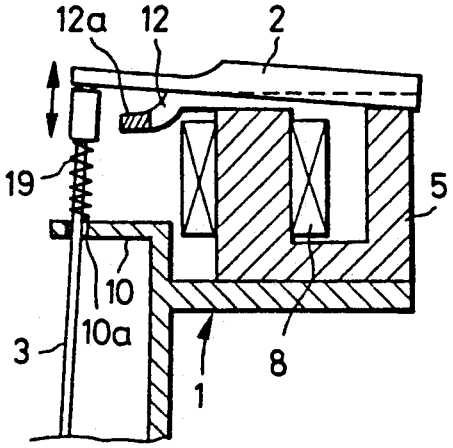
FIG. 2 is a cross sectional view showing part of the head of FIG. 1.
Figure 3:
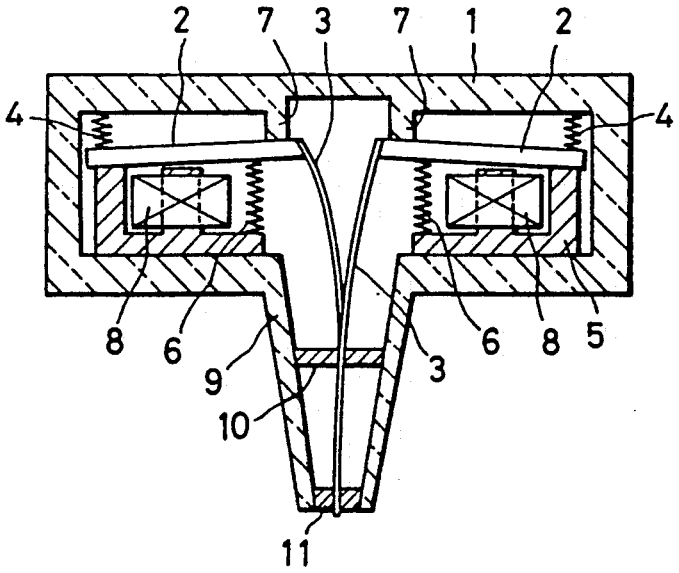
PRIOR ART FIG. 3
FIG. 3 is a cross sectional view showing a conventional printer head.
Figure 4:
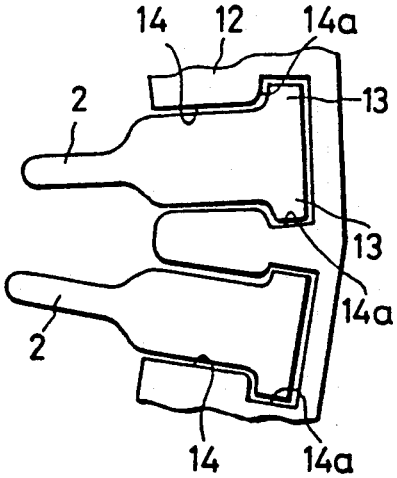
PRIOR ART FIG. 4
FIG. 4 is a plan view showing essential part of a housing of the printer head of FIG. 3.

Referring to FIGS. 1 and 2, there is shown an embodiment of head for a wire dot printer according to the present invention. It is to be noted that like parts are denoted by like reference numerals to those of FIGS. 3 and 4 and overlapping description thereof will be omitted herein to avoid redundancy. The head shown includes a plurality of armatures 2 each of which has a laterally extending tab 15 formed on one side of an outer end portion thereof and a recess 16 formed on the other side of the outer end portion thereof. Accordingly, the position of the center of the outer end portion of each of the armatures 2 in a widthwise direction of the armature 2 is offset or displaced in a circumferential direction of a housing 1 relative to the position of the center of the remaining portion of the armature 2 in the widthwise direction of the armature 2. Further, a guide member 12 is located between each adjacent pair of ones of the armatures 2. Inner end portions of the guide members 12 are fixed by a ring portion 12*a* which interconnects the inner end portions of the guide members 12 while an outer end portion of each of the guide members 12 has a recess 18 formed therein for receiving the tab 15 of an adjacent armature 2 therein and a tab 17 formed thereon for fitting in the recess 16 of the other adjacent armature 2.

Referring particularly to FIG. 2, the housing 1 has an intermediate guide plate 10 formed thereon. The intermediate guide plate 10 has a plurality of perforations 10*a* formed therein for retaining wires 3 in respective predetermined positions. A plurality of coil springs 19 are located on an upper face in FIG. 2 of the guide plate 10 and fitted around corresponding ones of the wires 3 for individually urging the corresponding wires 3 upwardly in FIG. 2. Upper ends of the wires 3 are secured to inner ends of the armatures 2.

With the construction described above, if a selected one of a plurality of coils 8 on a yoke core 5 is energized, a corresponding one of the armatures 2 is attracted by the coil 8 so that the inner end portion thereof pushes out the corresponding wire 3 against the urging force of the spring 19 to effect printing. In this instance, the armature 2 is restrained from moving in a circumferential direction of the housing 1 by the adjacent guide members 12 so that it can stably make a reciprocal motion in upward and downward directions in FIG. 2.

As described above, in the present embodiment, each of the armatures 2 has a tab 15 and a recess 16 formed at an outer end portion thereof such that the position of the center of the outer end portion of the armature 2 in a widthwise direction of the armature 2 may be offset or displaced in a circumferential direction of the housing 1 relative to the position of the center of the remaining portion of the armature 2 in the widthwise direction of the armature 2, and the tab 15 and the recess 16 are fitted with the recess 18 of one of two adjacent guide members 12 and the tab 17 of the other adjacent guide member 12, respectively. Accordingly, the width of the outer end portion of each of the armatures 2 can be substantially equal to the width of the remaining portion of the armature 2 as seen in FIG. 1. Consequently, the armatures 2 can be held in a high density. Accordingly, the outer diameter of the housing 1 can be reduced, and the print head can certainly be reduced in size and weight while it can print a same number of dots with its print wires.

As apparent from the foregoing description, according to the present invention, armatures can be arranged in a high density. Accordingly, an effect can be anticipated that a head can be reduced in size and weight.

Having now fully described the invention, it will be apparent to one of ordinary skill in the art that many changes and modifications can be made thereto without departing from the spirit and scope of the invention as set forth herein.

What is claimed is:

1. An improved head for a wire dot printer having a cylindrical housing in combination with a plurality of armatures located in a circumferential row and extending in radial directions within said housing, each of said armatures being supported at a radially outer end portion thereof for reciprocal rocking motion to actuate a print wire secured to a radially inner end portion thereof, and a guide member located between each pair of adjacent ones of said armatures for restraining movement of the adjacent armatures in directions other than directions of the reciprocal rocking motion, wherein the improvement comprises:

each of said armatures being longitudinally asymmetrically shaped and having an outer end portion defining a laterally extending tab on one side and a recess on the other side; and each of said guide members being longitudinally asymmetrically shaped and having an outer end portion defining a laterally extending tab on one side for fitting with the recess of an adjacent one of said armatures, and defining a recess on the other side for fitting with the laterally extending tab of an adjacent one of said armatures.

2. A head for a wire dot printer according to claim 1, wherein the improvement further comprises a circular member used to connect, to each other, the inner end portions of each of said guide members.

3. A head for a wire dot printer according to claim 2, wherein said guide members and said circular member are formed as a unitary member.

* * * * *